US006173698B1

(12) United States Patent
DeGroot et al.

(10) Patent No.: US 6,173,698 B1
(45) Date of Patent: Jan. 16, 2001

(54) CLOSED LOOP EXHAUST GAS SENSOR FUEL CONTROL AUDITED BY DYNAMIC CRANKSHAFT MEASUREMENTS

(75) Inventors: Kenneth P. DeGroot, Macomb Township; Bruce H. Teague, Grosse Pointe Park; Jonathan F. Rose, Westland, all of MI (US)

(73) Assignee: DaimlerChrysler Corporation, Auburn Hills, MI (US)

( * ) Notice: Under 35 U.S.C. 154(b), the term of this patent shall be extended for 0 days.

(21) Appl. No.: 09/442,252

(22) Filed: Nov. 17, 1999

(51) Int. Cl.[7] ..... F02D 41/14
(52) U.S. Cl. ..... 123/436
(58) Field of Search ..... 123/436, 406.24, 123/406.25

(56) References Cited

U.S. PATENT DOCUMENTS

| | | | | |
|---|---|---|---|---|
| 4,271,798 | * | 6/1981 | Seitz et al. | 123/436 |
| 4,829,963 | | 5/1989 | Oblaender et al. | 123/436 |
| 5,050,554 | | 9/1991 | Ichikawa | 123/406.27 |
| 5,237,862 | | 8/1993 | Mangrulkar et al. | 73/116 |
| 5,426,587 | | 6/1995 | Imai et al. | 701/111 |
| 5,492,102 | | 2/1996 | Thomas et al. | 123/493 |
| 5,544,521 | | 8/1996 | McCombie | 73/117.3 |
| 5,605,132 | | 2/1997 | Hori et al. | 123/406.24 |
| 5,630,397 | | 5/1997 | Shimizu et al. | 123/436 |
| 5,809,969 | | 9/1998 | Fiaschetti et al. | 123/436 |
| 5,954,028 | * | 9/1999 | Miyashita et al. | 123/436 |
| 6,085,734 | * | 7/2000 | DeGroot et al. | 123/436 |

* cited by examiner

*Primary Examiner*—Andrew M. Dolinar
(74) *Attorney, Agent, or Firm*—Mark P. Calcaterra

(57) ABSTRACT

A methodology of computing a combustion stability value and using the combustion stability value to control engine operation is provided. The combustion stability value is determined by monitoring engine operation. The combustion stability value is compared to an expected combustion stability value. Where the combustion stability value is greater than the expected combustion stability value, combustion of the internal combustion engine is controlled as a function of the combustion stability value. Where the combustion stability value is not greater than the expected combustion stability value, combustion of the internal combustion engine is controlled as a function of an $O_2$ sensor value. In either case, engine control is accomplished by modifying a target fuel injection value.

20 Claims, 4 Drawing Sheets

CLOSED LOOP EXHAUST GAS SENSOR FUEL CONTROL AUDITED BY DYNAMIC CRANKSHAFT MEASUREMENTS

FIELD OF THE INVENTION

The present invention relates generally to internal combustion engines in automotive vehicles and, more particularly, to a method of determining combustion stability of the engine and controlling the fuel injection pulsewidth to fuel injectors for the engine.

BACKGROUND OF THE INVENTION

An internal combustion engine may operate in a variety of different conditions, particularly in modern engine systems that are electronically controlled based upon a variety of monitored engine operating parameters. In each operating mode it is not uncommon to use different techniques to determine the amount of fuel to deliver to the engine for a fuel delivery cycle. For example, different fuel rate maps might be utilized in two different modes, or a fuel rate map may be used in one mode and an engine speed closed-loop control may be used in another mode.

Automotive vehicles commonly employ a port-injected internal combustion engine in which a fuel injector sprays fuel into air in an intake manifold of the engine near an intake valve of a cylinder as air gets pulled into the cylinder during the cylinder's intake stroke. The conventional fuel injector is typically controlled in response to a fuel injection pulsewidth signal in which the pulsewidth determines the amount of fuel injected into the corresponding cylinder of the engine. The fuel injection pulsewidth signal can be implemented to follow a programmed target fuel injection curve. The programmed target fuel injection curve determines the fuel injection pulsewidth and is generally utilized to provide adequate engine performance when feedback engine control is not available.

Many automotive vehicles commonly employ an oxygen ($O_2$) sensor generally disposed upstream of the exhaust system for sensing the oxygen level in the exhaust gas emitted from the engine. The oxygen sensor can serve to provide a feedback signal to control engine operation and adjust fuel injection to the engine to achieve better engine performance. Some conventional oxygen sensors, however, are required to warm up to a sufficiently high temperature before an accurate oxygen sensor reading may be obtained. Also, following an engine start, the oxygen sensor and processing devices initially may not have acquired enough information to provide adequate feedback control. Therefore, for a period of time immediately following cold start up of the vehicle engine, the oxygen sensor may not be capable of providing accurate information with which the engine may be controlled to operate to achieve low hydrocarbon emissions. As a consequence, excessive hydrocarbon emissions may be emitted from the vehicle within the immediate period following start up of the engine.

Additionally, immediately following a cold engine start, the catalyst of the catalytic converter can be ineffective because the catalyst requires a period of time to warm up to a temperature at which the catalyst can operate effectively to burn excess hydrocarbons. As a consequence, hydrocarbon emissions may initially be high due to poor burning of the excess hydrocarbons due to a low temperature catalyst. Adding to the problem, an over abundance of fuel in the catalyst may further cool the catalyst, thereby requiring an extended period of time for the catalyst to warm up to a sufficient operating temperature.

One approach for modifying fuel injection to the engine is described in U.S. Pat. No. 5,492,102, entitled "Method of Throttle Fuel Lean-Out for Internal Combustion Engines", issued to Thomas et al. on Feb. 20, 1996. The aforementioned issued U.S. patent is incorporated herein by reference. The approach described in the above-identified issued patent calculates a fuel lean-out multiplier value that is applied to a fuel pulsewidth value of the fuel injectors to reduce the amount of fuel injected into the engine by the fuel injectors. In the aforementioned approach, the fuel lean-out multiplier value is determined from a sensed throttle position and sensed deceleration.

It has also become increasing desirable to operate an engine lean in order to improve fuel efficiency and meet emissions standards. This is accomplished by adjusting the air/fuel ratio, which, in internal combustion engine design, is typically considered to be the ratio of the mass flow rate of air to the mass flow rate of fuel inducted by the engine to achieve conversion of the fuel into completely oxidized products. The chemically correct ratio corresponding to complete oxidation of the products is called stoichiometric. If too much fuel is being burned in proportion to the amount of air to achieve perfect combustion, the air/fuel ratio is less than stoichiometric and the engine is said to be operating rich. Manipulating the air/fuel ratio to rich is typically advantageous in achieving maximum power such as during acceleration of an automobile. Similarly, if too much air is being burned in proportion to the amount of fuel to achieve perfect combustion, the air/fuel ratio is greater than stoichiometric, and the engine is said to be operating lean. Operating the engine lean is typically advantageous in achieving fuel savings when maximum power is not needed. Operating the engine lean furthermore provides the advantage of reduced cylinder head temperatures.

Conventionally, immediately after the start of the engine, the air/fuel ratio supplied to the engine is controlled to a value richer than a stoichiometric air/fuel ratio in order to ensure stability of rotation of the engine. The ability to maintain the required stability of rotation of the engine even when the air/fuel ratio is controlled to a leaner value than the stoichiometric air/fuel ratio would realize the fuel efficiency and emissions benefits of lean engine operation.

But controlling the air/fuel ratio of the mixture to a leaner value than the stoichiometric air/fuel ratio is not possible for all operating conditions of the engine. For example, when the engine temperature is higher than an expected value, fuel vapor can be generated in the fuel supply line causing problems of low stability of rotation of the engine, and even engine stalling. Also, upon a sudden change in the air/fuel ratio, e.g., from a leaner value than the stoichiometric air/fuel ratio to the stoichiometric air/fuel ratio, there also can occur unstable rotation of the engine. Thus, in order to realize the benefits of a lean fuel air/fuel ratio, a method for monitoring engine operation stability is necessary.

An approach to monitoring combustion and computing a learned combustion stability value and applying the learned combustion stability value to control engine operation is described in U.S. Pat. No. 5,809,969, entitled "Method For Processing Crankshaft Speed Fluctuations For Control Applications," issued to Fiaschetti et al. on Sep. 22, 1998. The aforementioned issued U.S. patent is incorporated herein by reference. According to the methodology, engine speed is sensed for each expected firing of individual cylinders of the engine. The difference in engine speed for a selected cylinder firing and a cylinder firing occurring two cylinder firings earlier is determined to provide an expected acceleration value. The difference between successive expected acceleration values is computed. A learned combustion-related value is determined as a function of the difference in the successive learned acceleration values and is an indication of engine roughness. The learned combustion-related value is used to modify the fuel injection to an internal combustion engine, especially following a cold start, whereby hydrocarbon emissions can be reduced. This is accomplished by modifying a program target fuel injection value as a function of the learned combustion-related value so as to reduce the fuel injected into the engine by fuel injectors.

SUMMARY OF THE INVENTION

In accordance with the teachings of the present invention, a methodology of computing a combustion stability value and applying the combustion stability value to control engine operation is provided. Engine speed is sensed for each expected firing of individual cylinders of the engine. The difference in engine speed for a selected cylinder firing and a cylinder firing occurring two cylinder firings earlier is determined to provide an expected acceleration value. The combustion stability value is determined as a function of the difference between the successive acceleration values and may be used as an indication of engine roughness. The operation of the engine is controlled as a function of the combustion stability value. If the combustion stability value is greater than an expected combustion value, a programmed target fuel injection signal pulsewidth is modified as a function of the combustion stability value. If the combustion stability value is less than an expected combustion value, a programmed target fuel injection signal pulsewidth is modified as a function of a comparison of an $O_2$ sensor value and an $O_2$ sensor expected value. Through use of both fuel injection signal pulsewidth modifications, reduced hydrocarbon emissions are realized while maintaining good driveability and performance of the vehicle.

Further areas of applicability of the present invention will become apparent from the detailed description provided hereinafter. It should be understood, however, that the detailed description and specific examples, while indicating preferred embodiments of the invention, are intended for purposes of illustration only, because various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
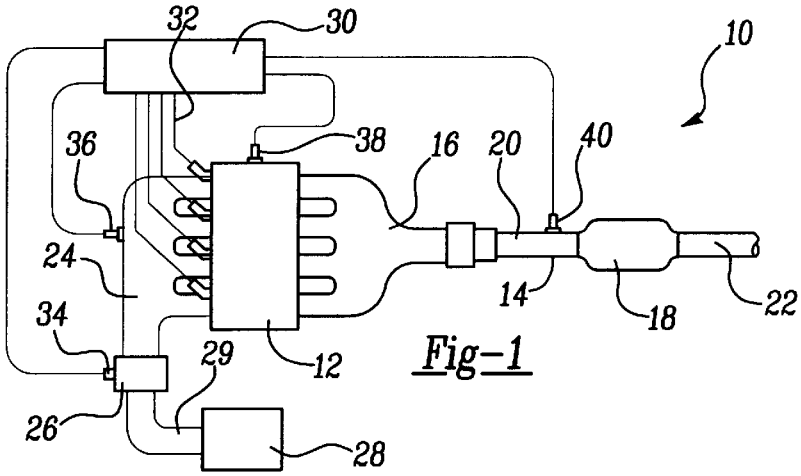
FIG. 1 is a schematic diagram of an electronic fuel injection system illustrated in operational relationship with an internal combustion engine and exhaust system of an automotive vehicle.

Turning now to FIG. 1, an electronic fuel injection system 10 is illustrated in operational relationship with an internal combustion engine 12 and an exhaust system 14 of an automotive vehicle (not shown). The exhaust system 14 includes an exhaust manifold 16 connected to the engine 12 and a catalyst 18, such as a catalytic converter, connected by an upstream conduit 20 to the exhaust manifold 16. The exhaust system 14 also includes a downstream conduit 22 connected to the catalyst 18 and extending downstream to a muffler (not shown). The internal combustion engine 12 is a fuel injected engine and includes an intake manifold 24 connected to the engine 12 and a throttle body 26 connected to the intake manifold 24. The engine 12 also includes an air filter 28 connected by a conduit 29 to the throttle body 26. It should be appreciated that the engine 12 and exhaust system 14 are conventional and known in the art.

The electronic fuel injection system 10 includes an engine controller 30 having fuel injector outputs 32 connected to corresponding fuel injectors (not shown) of the engine 12. The fuel injectors meter an amount of fuel to cylinders (not shown) of the engine 12 in response to a pulsewidth value output from the engine controller 30 via fuel injector output lines 32. The electronic fuel injection system 10 also includes a throttle position sensor 34 connected to the throttle body 26 and the engine controller 30 to sense an angular position of a throttle plate (not shown) in the throttle body 26. The electronic fuel injection system 10 includes a manifold absolute pressure (MAP) sensor 36 connected to the intake manifold 24 and the engine controller 30 to sense manifold absolute pressure. The electronic fuel injection system 10 also includes a coolant temperature sensor 38 connected to the engine 12 and the engine controller 30 to sense a temperature of the engine 12. The electronic fuel injection system 10 further includes an oxygen ($O_2$) sensor 40 connected to the upstream conduit 20 of the exhaust system 14. The oxygen sensor 40 is also connected to the engine controller 30 to sense the oxygen level in the exhaust gas from the engine 12. It should be appreciated that the engine controller 30 and sensors 34, 36, 38 and 40 are conventional and known in the art.

Figure 2:
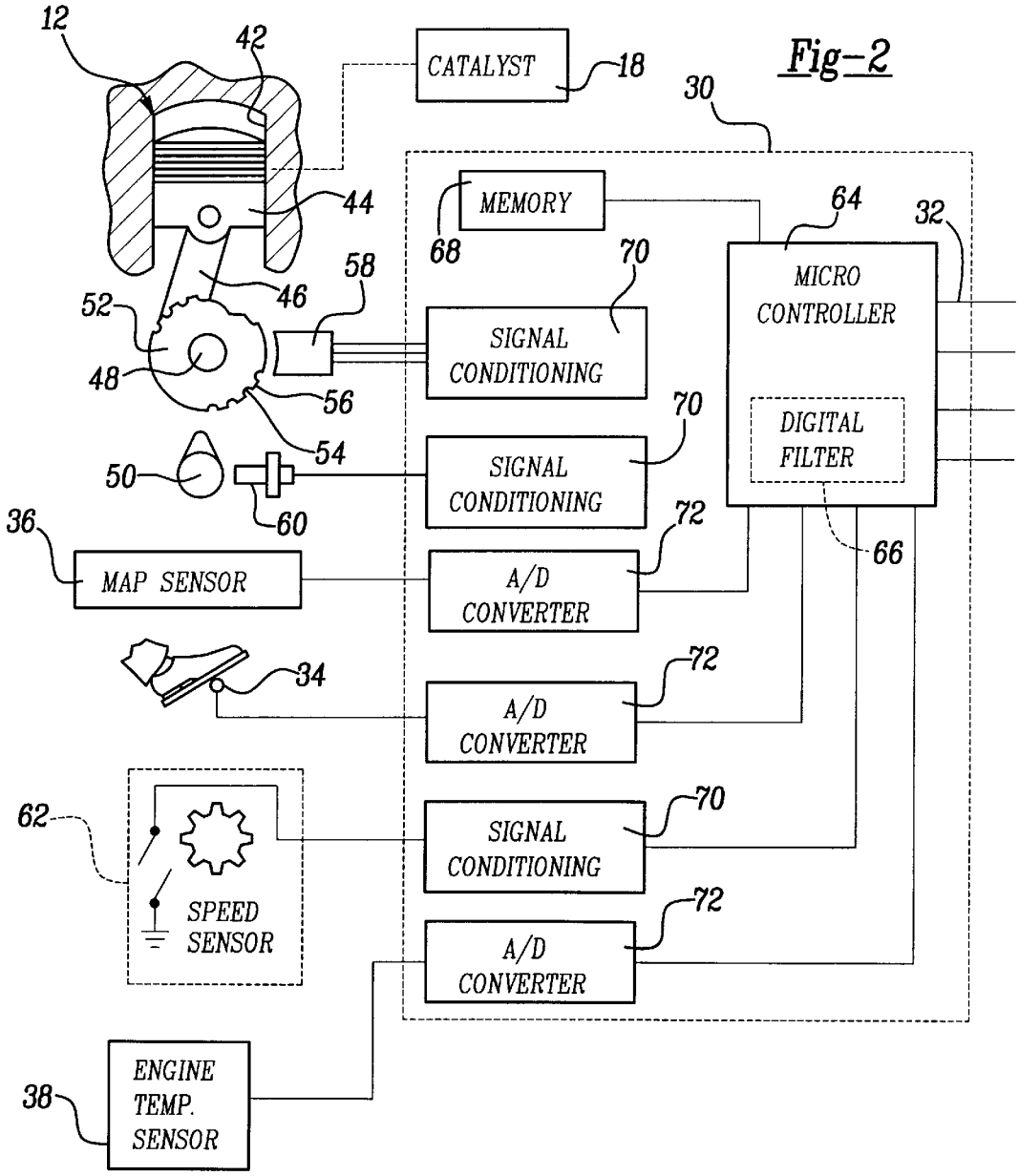
FIG. 2 is a block diagram further illustrating vehicle components used for sensing engine speed from a crankshaft and modifying fuel injection to the engine.

Referring to FIG. 2, a block diagram is provided which illustrates the components of the automotive vehicle for measuring engine speed, determining a combustion stability value, and modifying fuel injection to the engine. A partial cut-away view of engine 12 is shown illustrating one of a multiple of cylinders 42 in the engine 12. As illustrated, a piston 44 is disposed in the cylinder 42 and is operatively connected by a connecting rod 46 to a crankshaft 48. A camshaft 50 is used to open and close at least one valve (not shown) of the cylinder 42 for various strokes of the piston 44. The piston 44 is illustrated in the expansion (power) stroke of a four-stroke engine. In such a four-stroke engine, the strokes include intake, compression, expansion (power), and exhaust. During the exhaust stroke, exhaust gases flow from the cylinder 42 via at least one valve and through the exhaust system 14. Although the embodiment shown is a four-stroke engine, the principles of the present invention can also be applied to other internal combustion engines, such as a two-stroke engine. It should be appreciated that a spark plug is present in the preferred embodiment, although it is not illustrated herein.

The automotive vehicle further includes a sensor target 52 operatively connected to the crankshaft 48. The sensor target 52 has at least one trip point, and preferably a plurality of trip points, which in the preferred embodiment are provided as slots 54 formed by teeth 56. The vehicle also includes a crankshaft sensor 58 for communicating with the sensor target 52 and a camshaft sensor 60 in communication with the camshaft 50. The vehicle further includes the manifold absolute pressure (MAP) sensor 36, throttle position sensor 34, a vehicle speed sensor 62 and an engine temperature sensor 38. The outputs of the sensors 58, 60, 36, 34, 62 and 38 communicate with the engine controller 30.

The engine controller 30 includes a micro-controller 64 with a digital filter 66, memory 68, signal conditioning circuitry 70 and analog-to-digital (A/D) converters 72 to process outputs from the various sensors according to the methodology to be described hereinafter. In the preferred embodiment, the outputs of crankshaft sensor 58, camshaft sensor 60, and vehicle speed sensor 62 communicate with the micro-controller 64 via appropriate signal conditioning circuitry 70 that is particularized to the type of sensor employed. The output of the manifold absolute pressure sensor 36, throttle position sensor 34 and engine coolant temperature sensor 38 communicate with micro-controller 64 via A/D converters 72. The engine controller 30 including micro-controller 64 with digital filter 66 is used to determine a combustion stability value and modify a fuel injection control signal as will be described in more detail hereinafter. Memory 68 is a generic memory which may include Random Access Memory (RAM), Read Only Memory (ROM) or other appropriate memory. It should also be appreciated that the engine controller 30 also includes various timers, counters and like components.

Figure 3:
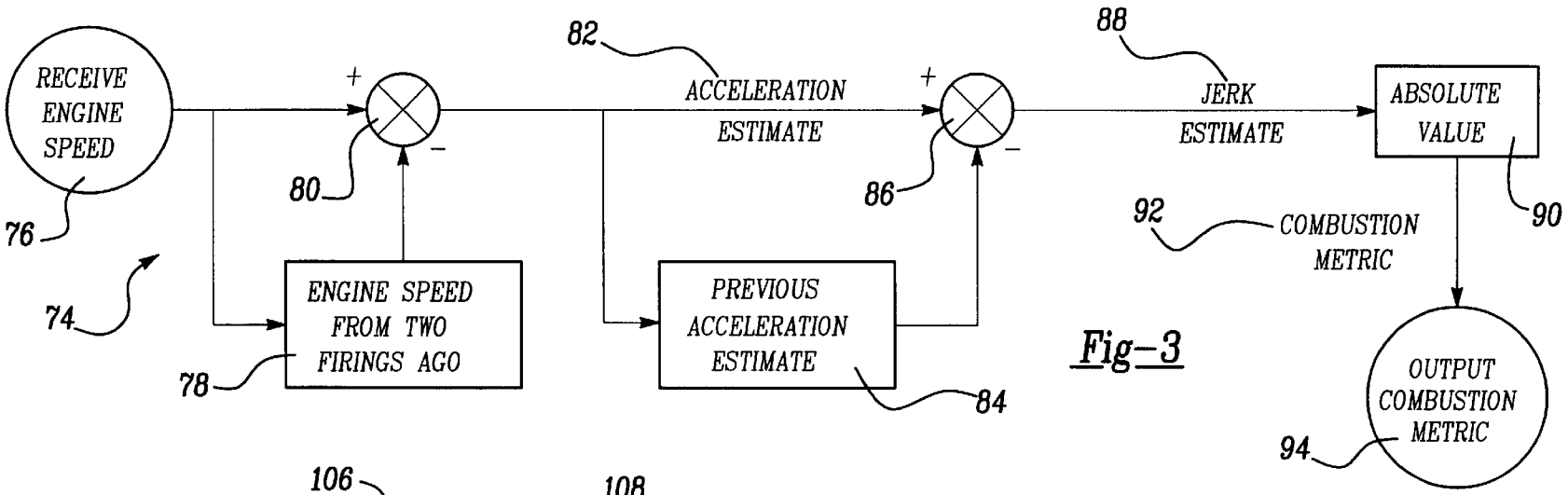
FIG. 3 is a flow diagram illustrating a methodology of computing a combustion stability value indicative of engine roughness according to the present invention.

With particular reference to FIG. 3, a methodology 74 of computing a combustion stability value that is indicative of the combustion roughness of the engine is provided. Methodology 74 may be carried out by engine controller 30, including micro-controller 64 with digital filter 66. Methodology 74 receives an engine speed signal 76 cylinder that may be determined as described above for each expected cylinder firing event. The engine speed signal for the current cylinder firing event (n) is compared with the engine speed signal occurring two firing events earlier (n−2) prior to the current cylinder firing event as shown by comparison block 80. The comparison block 80 provides a difference value between the current (n) engine speed and the engine speed determined two firing events earlier (n−2). The determined difference value is identified as an acceleration estimate value 82. The current (m) acceleration estimate value 82 is compared with the previous (m−1) acceleration estimate value 84 via a comparator 86. Comparator 86 computes the difference between the current (m) acceleration estimate value and the previous (m−1) acceleration estimate value and outputs a jerk estimate value 88. An absolute value of the jerk estimate value 88 is taken in block 90 and provides a positive output value 90 that is identified as a combustion metric value 92. As an alternate embodiment, methodology 74 could mathematically square the jerk estimate value 88 instead of taking the absolute value. The square function would still provide a position output value. The combustion metric value 92 is shown output pursuant to block 94. Accordingly, methodology 74 computes an output combustion metric value based on the difference between successive acceleration estimate values as determined from the received engine speed signal. The output combustion metric value is a learned combustion stability value indicative of the roughness of the engine combustion.

Figure 4:
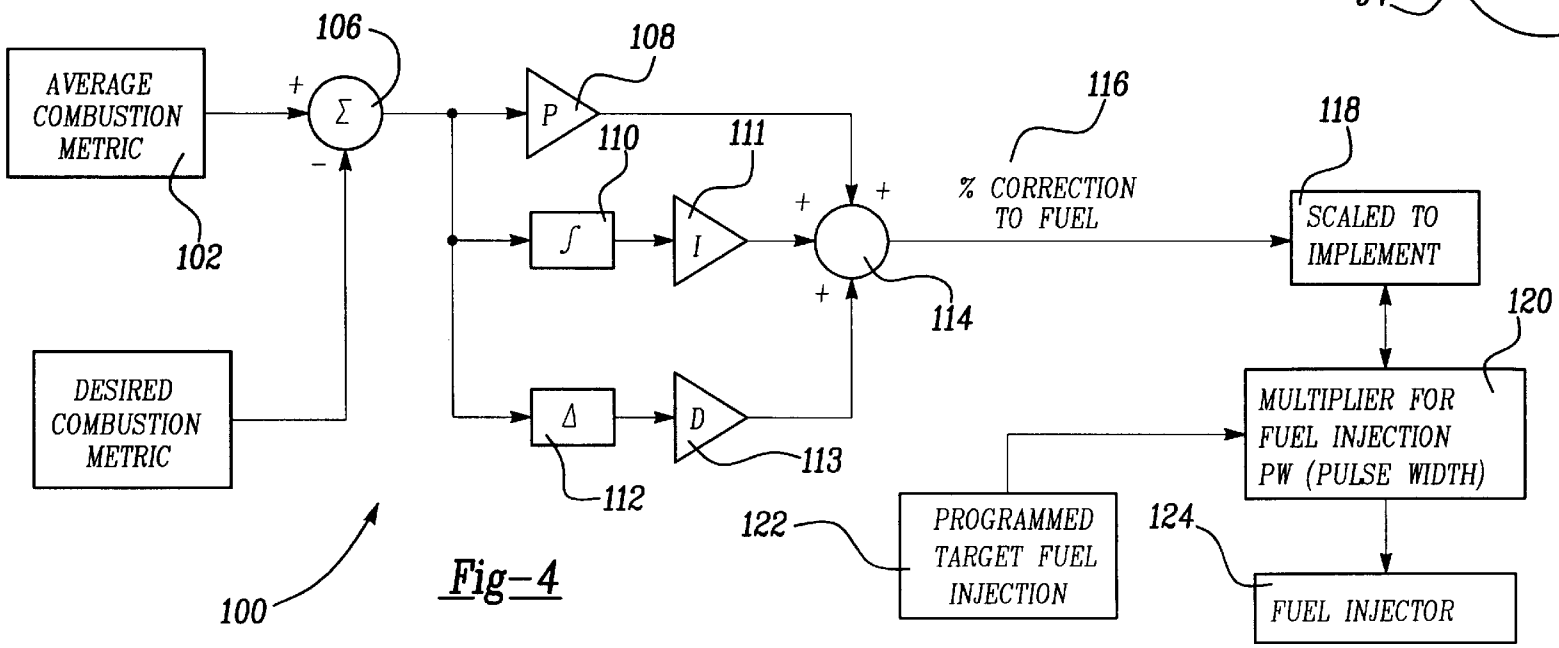
FIG. 4 is a flow diagram illustrating use of the combustion stability value to modify fuel injection to an engine according to the present invention.

Referring to FIG. 4, a methodology 100 is illustrated for modifying the fuel injection pulsewidth signal to fuel injectors of the engine as a function of the combustion metric value according to the present invention. Fuel injection modification methodology 100 computes an average combustion metric value from the combustion metric value as provided in block 102 and compares the average combustion metric value with a desired combustion metric value 104 as provided to comparator 106. The desired combustion metric value is preferably programmed as a function of engine speed, manifold absolute pressure, and coolant temperature and offers a control signal for controlling the fuel injection to the engine. Comparator 106 outputs a difference value between the average combustion metric value and the desired combustion metric and provides proportional-integral-derivative (PID) control.

The PID control includes a proportional (P) gain block 108, an integral (∫) block 110, and a differential (Δ) block 112. Each of the proportional, integral, and differential blocks 108, 110, and 112, respectively, receives the output from comparator 106. The output from the proportional gain block 108 is applied to a summation block 114. The output of the integral block 110 is applied to a gain (I) block 111 and then output to the summation block 114. The output of the differential block 112 is applied to a gain (D) block, 113 and then output to the summation block 114. The summation block 114 sums the inputs so as to provide a percentage correction value 116 that in turn is used to modify the fuel injection to the engine. The percentage correction value 116 is scaled in block 118 for implementation as a multiplier value. Scaling of the percentage correction value may be accomplished by adding 1.0 to the fractional percentage correction value, according to one example. Methodology 100 provides a multiplier for the fuel injection pulsewidth such that the amount of fuel injected to the engine may be reduced from the scheduled amount provided in the programmed target fuel injection value 122. Accordingly, the programmed target fuel injection 122 is scaled by way of the multiplier 120 to realize a reduction of fuel supplied by the fuel injectors as provided in block 124.

For a period of time following vehicle start-up, the fuel modification methodology 100 utilizes the combustion metric value so as to reduce the amount of fuel injected into the individual cylinders of the engine as may be appropriate to reduce hydrocarbon emissions emitted from the vehicle. The time period for modifying the fuel injection preferably lasts long enough until effective feedback control with the oxygen sensor 40 may be realized. The time period may be set for forty seconds, according to one example. Varying time periods, however, may be necessary depending upon the engine, temperature, fuel combustibility as well as other factors. According to the example shown, it is preferred that the fuel modification methodology 100 be utilized to reduce the amount of fuel injected into the engine.

Once effective feedback control with oxygen sensor 40 is realized, a second methodology 150 for modifying the fuel injection pulsewidth signal to fuel injectors of the engine as a function of the combustion metric value according to the present invention is employed. As explained above, lean engine operation includes fuel efficiency and helps meet emissions standards. Where a combustion stability value of the present invention is less than the expected combustion metric, it is desirable to operate the engine lean of stoichiometric. Accordingly, by using the combustion stability value, which is indicative of the combustion roughness of the engine, the methodology 150 may be carried out by engine controller 30, including micro-controller 64 of digital filter 66, to reduce fuel provided to fuel injectors in order to reduce hydrocarbon emissions while maintaining good driveability of the vehicle.

Figure 5:
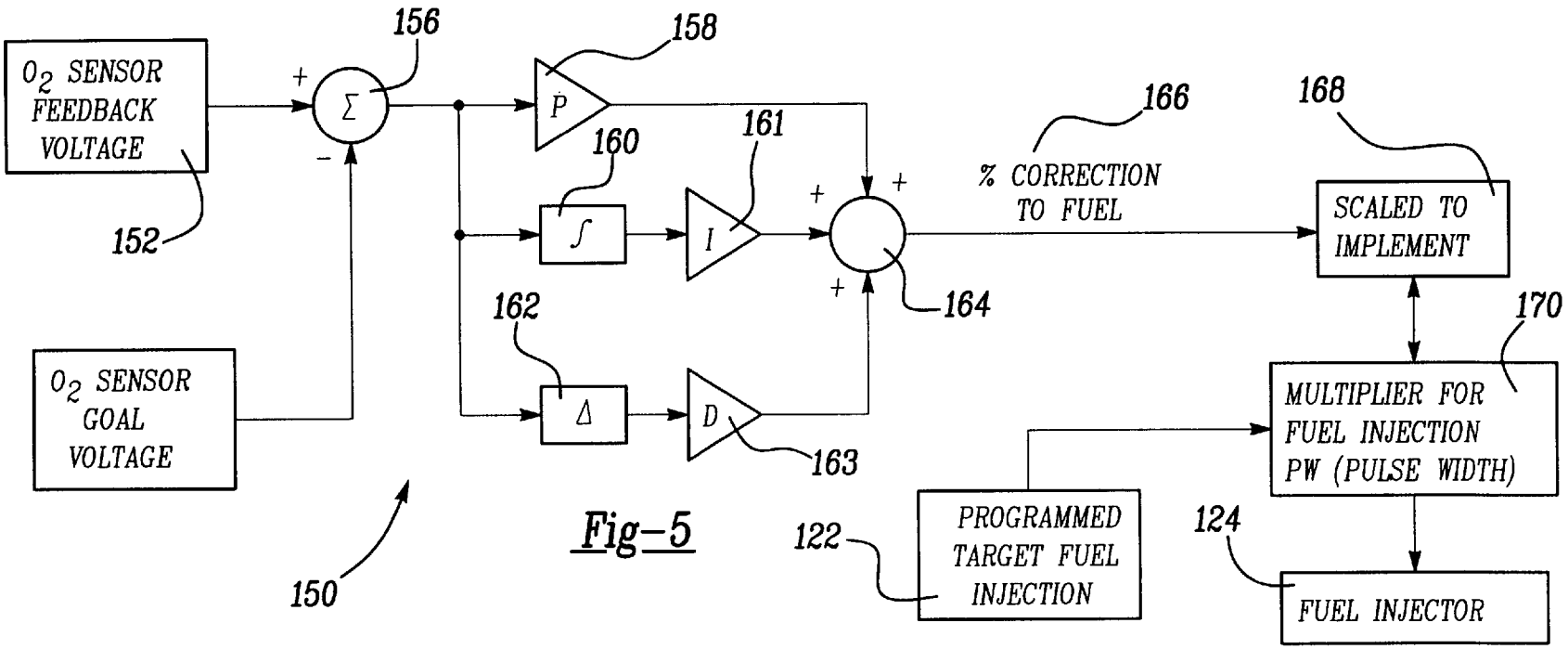
FIG. 5 is a flow diagram illustrating use of $O_2$ sensor feedback to modify fuel injection to an engine according to the present invention.

Referring to FIG. 5, a methodology 150 is illustrated for modifying the fuel injection pulsewidth signal to fuel injectors of the engine as a function of feedback from $O_2$ sensor 40 connected to the upstream conduit 20 of the exhaust system 14. Fuel injection modification methodology 150 reports the $O_2$ sensor feedback voltage in block 152 and compares the feedback value with an $O_2$ sensor goal voltage as provided by comparator 156. The $O_2$ sensor goal voltage is preferably programmed as a function of engine speed, manifold absolute pressure, and coolant temperature, and offers a control signal for controlling the fuel injection to the engine. Comparator 156 outputs a difference value between the $O_2$ sensor feedback voltage and the $O_2$ sensor goal voltage and provides proportional-integral-derivative (PID) control.

As before, the PID control includes a proportional (P) gain block 158, an integral (∫) block 160, and a differential (Δ) block 162. Each of the proportional, integral, and differential blocks 158, 160, and 162, respectively receives the output from comparator 156. The output from the proportional gain block 158 is applied to summation block 164. The output of the integral block 160 is applied to gain (I) block 161 and then output to the summation block 164. The output of the differential block 162 is applied to a gain (D) block 163, and then output to the summation block 164. Summation block 164 sums the input so as to provide a percentage correction value 166 that in turn is used to modify the fuel injection to the engine. The percentage correction value 166 is scaled in block 168 for implementation as a multiplier value. Scaling of the percentage correction value may be accomplished by adding 1.0 to the fractional percentage correction value, according to one example. Methodology 150 provides a multiplier for the fuel injection pulsewidth so that the amount of fuel injected to the engine may be reduced from the scheduled amount provided in the programmed target fuel injection value 122. Accordingly, the programmed target fuel injection 122 is scaled by way of multiplier 170 to realize a reduction of fuel supplied by the fuel injectors as provided in block 124.

Figure 6:
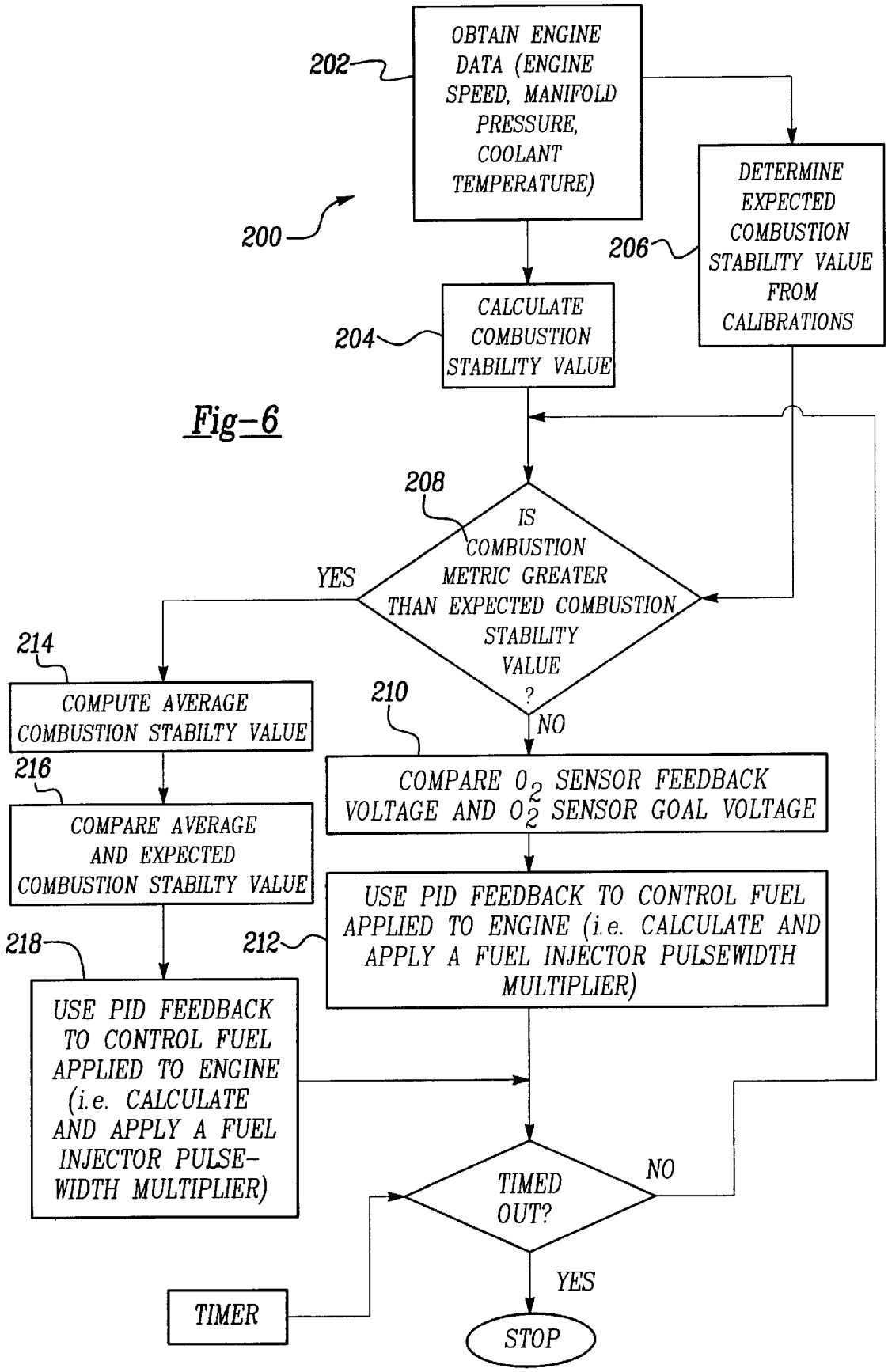
FIG. 6 is a flow diagram further illustrating the methodology of using the combustion stability value and the $O_2$ sensor feedback to modify fuel injection to the engine according to the present invention.

Referring to FIG. 6, a methodology 200 is illustrated for computing a combustion stability value and an $O_2$ sensor value, and utilizing the combustion stability value or $O_2$ sensor value to provide fuel modification to fuel injectors of the engine. Methodology 200 begins with obtaining engine data such as engine speed, manifold absolute pressure and coolant temperature, as shown in block 202. At block 204, methodology 200 calculates the combustion stability value as was described above in connection with FIG. 3. Further, in block 206, an expected combustion stability value is determined from the engine data and calibrations. Next, in block 208, it is determined whether the calculated combustion stability value is greater than the expected combustion stability value. If not, fuel injection modification is performed according to methodology 150, as explained above. More specifically, in block 210, $O_2$ sensor feedback voltage is compared to the $O_2$ sensor goal voltage to provide a difference output. Then, proportional-integral-differential (PID) control is used in block 212 to control the combustion quality of the engine based on the difference output by calculating and applying a fuel injector pulsewidth multiplier to the programmed fuel injection signal to reduce the amount of fuel applied to the engine.

If, however, the calculated combustion stability value is greater than the expected combustion stability value, an average combustion stability value is computed pursuant to block 214. Also, the expected combustion stability value of block 206 and the computed average combustion stability value of block 214 are compared via block 216 to provide a difference output between the two input signals. According to block 218, methodology 100 uses proportional-integral-differential (PID) control to control the combustion quality of the engine based on the difference output by calculating and applying a fuel injector pulsewidth multiplier to the programmed fuel injection signal to reduce the amount of fuel applied to the engine.

Through either control methodology fuel reduction is provided while maintaining adequate driveability and performance of the vehicle, with reduced emissions when possible, especially following a cold engine start of the vehicle. Accordingly, the modified fuel injection reduces hydrocarbon emissions while maintaining good driveability of the vehicle when the oxygen sensor and/or feedback control may not be available.

It should be appreciated that the combustion stability value of the present invention provides an indication of engine roughness. While the preferred embodiment utilizes the combustion stability value to modify fuel injection to achieve reduced hydrocarbon emissions, it should be appreciated that other applications of the learned combustion stability value may exist.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling combustion in an internal combustion engine, said method comprising the steps of:

determining a combustion stability value indicative of engine roughness;

comparing said combustion stability value to an expected combustion stability value;

controlling combustion of said internal combustion engine as a function of said combustion stability value if said combustion stability value is greater than said expected combustion stability value; and controlling combustion of said internal combustion engine as a function of an $O_2$ sensor value if said combustion stability value is not greater than said expected combustion stability value.

2. The method as defined in claim 1 wherein said step of determining said combustion stability value comprises:

sensing engine speed for each expected firing of individual cylinders of said internal combustion engine;

determining a difference in engine speed for a selected cylinder firing and a cylinder firing occurring two expected cylinder firings prior to said selected cylinder firing, said difference in engine speed providing an acceleration estimate value;

determining a difference between a current acceleration estimate value and a preceding acceleration estimate value to provide an acceleration difference value; and determining said combustion stability value as a function of said acceleration difference value.

3. The method as defined in claim 2 wherein said step of determining said combustion stability value further comprises a step of determining a positive value of the acceleration difference value.

4. The method as defined in claim 2 wherein said step of sensing engine speed comprises measuring angular rotation of a crankshaft.

5. The method as defined in claim 1 wherein said step of controlling combustion of said internal combustion engine as a function of said combustion stability value comprises:

determining an average combustion stability value;

comparing said average combustion stability value with said expected combustion stability value; and modifying fuel injection to the engine as a function of said comparison step.

6. The method as defined in claim 5 further comprising a step of processing a difference value between said average combustion stability value and said combustion stability value in accordance with proportional-integral-differential control.

7. The method as defined in claim 6 further comprising a step of scaling a programmed target fuel injection value with an output value of said step of processing said difference value between said average combustion stability value and said expected combustion stability value.

8. The method as defined in claim 1 wherein said step of controlling combustion of said internal combustion engine as a function of an $O_2$ sensor value comprises:

comparing a goal $O_2$ sensor value with said $O_2$ sensor value; and modifying fuel injection to said engine as a function of said comparison step.

9. The method as defined in claim 8 further comprising a step of processing a difference value between said goal $O_2$ sensor value and said $O_2$ sensor value in accordance with proportional-integral-differential control.

10. The method as defined in claim 9 further comprising a step of scaling a programmed target fuel injection value with an output value of said step of processing said difference value between said goal $O_2$ sensor value and said $O_2$ sensor value.

11. A method of controlling fuel injection to an internal combustion engine, said method comprising the steps of:

measuring engine speed;

measuring an $O_2$ sensor value;

learning a combustion stability value as a function of the measured engine speed;

comparing an expected combustion stability value with said learned combustion stability value;

modifying a target fuel injection value as a function of said learned combustion stability value if said learned combustion stability value is greater than said expected combustion stability value; and modifying a target fuel injection value as a function of said $O_2$ sensor value if said learned combustion stability value is not greater than said expected combustion stability value.

12. The method as defined in claim 11 wherein said step of learning a combustion stability value comprises:

determining a difference in engine speed for a selected cylinder firing and a cylinder firing occurring two cylinder firings prior to the selected cylinder firing, said difference in engine speed providing an acceleration estimate value;

determining a difference between a current acceleration estimate value and a preceding acceleration estimate value to provide an acceleration difference value; and determining said learned combustion stability value as a function of said acceleration difference value.

13. The method as defined in claim 11 wherein said step of measuring engine speed comprises measuring angular rotation of a crankshaft.

14. The method as defined in claim 11 wherein said step of modifying a target fuel injection value as a function of said learned combustion stability value comprises:

determining an average combustion stability value;

comparing said average combustion stability value with said expected stability value; and modifying fuel injection to said engine as a function of said comparison step.

15. The method as defined in claim 14 further comprising a step of processing a difference value between said average combustion stability value and said expected stability value in accordance with proportional-integral-differential control.

16. The method as defined in claim 15 further comprising a step of scaling a programmed target fuel injection value with an output value of said step of processing said difference value between said average combustion stability value and said expected combustion stability value.

17. The method as defined in claim 11 wherein said step of modifying a target fuel injection value as a function of said $O_2$ sensor value comprises:

comparing a goal $O_2$ sensor value with said $O_2$ sensor value; and modifying fuel injection to said engine as a function of said comparison step.

18. The method as defined in claim 17 further comprising a step of processing a difference value between said goal $O_2$ sensor value and said $O_2$ sensor value in accordance with proportional-integral-differential control.

19. The method as defined in claim 18 further comprising the step of scaling a target fuel injection value with an output value of said step of processing said difference value between said goal $O_2$ sensor value and said $O_2$ sensor value.

20. A method of controlling fuel injection with fuel injectors to an internal combustion engine, said method comprising the steps of:

measuring engine speed for each expected firing of individual cylinders of said internal combustion engine;

measuring an $O_2$ sensor value;

determining a difference in engine speed for a selected cylinder firing and a cylinder firing occurring two cylinder firings prior to the selected cylinder firing, said difference in engine speed providing an acceleration estimate value;

determining a difference in successive expected acceleration values to provide for an acceleration difference value;

determining a combustion stability value as a function of said acceleration difference value;

comparing an expected combustion stability value with said combustion stability value;

modifying a fuel injection pulsewidth signal as a function of said combustion stability value if said combustion stability value is greater than said expected combustion stability value, said step of modifying said fuel injection pulsewidth signal as a function of said combustion stability value including:

determining an average combustion stability value;

comparing said average combustion stability value with said expected stability value; and processing a difference value between said average combustion stability value and said expected stability value in accordance with proportional-integral-differential control;

modifying a fuel injection pulsewidth signal as a function of said $O_2$ sensor value if said combustion stability value is not greater than said expected combustion stability value, said step of modifying said fuel injection pulsewidth signal as a function of said combustion stability value including:

comparing a goal $O_2$ sensor value with said $O_2$ sensor value; and processing a difference value between said goal $O_2$ sensor value and said $O_2$ sensor value in accordance with proportional-integral-differential control; and scaling said fuel injection pulsewidth signal with an output value of one of said step of modifying said fuel injection pulsewidth signal as a function of said learned combustion roughness value or said step of modifying said fuel injection pulsewidth signal as a function of said $O_2$ sensor value.

* * * * *